United States Patent [19]

Galamore et al.

[11] 3,934,536

[45] Jan. 27, 1976

[54] EXTENDABLE ANCHOR LINE GUIDE AND SUPPORT WITH AUTOMATIC RELEASE

[76] Inventors: Frazer W. Galamore, 54 Oak Ave., North Fort Myers, Fla. 33903; Sheldon S. Fulton, 2001 Triggerfish, Matlacha, Fla. 33901

[22] Filed: Nov. 5, 1974

[21] Appl. No.: 521,233

[52] U.S. Cl. ..... 114/210

[51] Int. Cl.[2] ..... B63B 21/22

[58] Field of Search..... 114/210, 206 R; 294/84; 254/192, 190 R; 242/157 R

[56] References Cited

UNITED STATES PATENTS

| | | | |
|---|---|---|---|
| 1,636,944 | 7/1927 | Schauman | 114/210 |
| 1,739,359 | 12/1929 | Hausenfluck | 114/210 |
| 1,744,057 | 1/1930 | Schauman | 114/210 |
| 3,242,894 | 3/1966 | Anderson | 114/210 |
| 3,675,608 | 7/1972 | Webb | 114/210 |

*Primary Examiner*—Trygve M. Blix
*Assistant Examiner*—Charles E. Frankfort
*Attorney, Agent, or Firm*—Clarence A. O'Brien; Harvey B. Jacobson

[57] ABSTRACT

A support arm is provided including base and outer ends and mounting structure is provided on the base end for mounting the support arm from a boat in a generally horizontally disposed position with the outer end of the support arm projecting outwardly of one side portion of the boat. The outer end of the support arm structure is bifrucated to provide an endwise outwardly opening vertical slot and the support arm includes outer end downwardly projecting and inwardly curving guide structure. Flexible tension member guide structure is mounted on the outer end of the support arm above the slot and guidingly receives an elongated flexible tension member extending generally lengthwise of the support arm. One free end portion of the flexible tension member depends downwardly through the slot and is equipped with anchor member attaching structure on its lower free end. The anchor member attaching structure is engageable with the lower end of the guide structure upon upward movement of the lower free end of the tension member for outward displacement of the anchor member attaching structure and an anchor attached thereto upon further upward movement of the tension member free end and the anchor member attaching structure supported therefrom. Upon final upward movement of the anchor member attaching structure to the upper extremity of the guide structure, further tension of the tension member is operative to inwardly displace the anchor member attaching structure to a position bridging the furcations of the outer end of the support arm for support of the anchor member attaching structure, and thus the anchor member, therefrom.

5 Claims, 4 Drawing Figures

140
2
96
67
92
94
84
90
88
100
78
76
124
80
16
120
116
114
46
32
10
14
48
58
63
59
54
64
60
12

65
66
68
102
104
108
110
38
42
44
40
36
34
30
70
32
74
72
18
22
20
52
96
26
94
92
88
28
86
84
82
76
90
98
80
100
78
124
122
126
120
112
114
118
54
46
59
62
63
50
56
60

147
145
143
141
140
139
67
144
132
88
76
26
84
86
88
142
65
68
3
3
104
126
102
108
106
110
70
120
122
72
124
116
125
18
10
46
48
58
128
63
59
60
64
62
130
12
54
58
76
120
62
64
128
60
62
122
124
48
18

EXTENDABLE ANCHOR LINE GUIDE AND SUPPORT WITH AUTOMATIC RELEASE

BACKGROUND OF THE INVENTION

Various types of anchor handling equipment has been heretofore designed for use on both large and small boats as well as much larger ships. Some of these previously designed structures are constructed in a manner whereby they must be manually operated and other structures of this type are designed whereby they may be remotely operated by a suitable power source. Still further, some previously designed anchor handling structure is operative merely to raise an associated anchor and does not include structure for supporting the raised anchor in a substantially motionless position against shifting into contact with adjacent portions of the associated boat.

Examples of previously designed anchor handling structure are disclosed in U.S. Pat. Nos. 1,640,672, 2,831,450, 2,845,039 and 3,242,894.

BRIEF DESCRIPTION OF THE INVENTION

The anchor handling structure of the instant invention is constructed in a manner whereby it may be readily constructed in various sizes for use in conjunction with various size boats ranging from a small runabout boat to a larger ship. In addition, the anchor handling structure of the instant invention may be readily modified for manual operation or for operation from a remote location. Still further, the anchor handling structure of the instant invention is capable of supporting an associated anchor in a raised condition against shifting relative to the anchor handling structure and therefore against shifting into contact with adjacent boat surfaces which might be damaged by contact of an anchor therewith.

Also, the anchor handling structure includes automatic latching structure for releasably latching the associated anchor in a raised position and operable from a remote location in order to release a raised anchor for lowering into the water.

The main object of this invention is to provide an anchor handling structure which will be capable of raising an associated anchor and supporting the raised anchor in an outboard position relative to an associated boat and in a stationary manner relative to the anchor handling structure.

Another object of this invention is to provide an apparatus in accordance with the preceding object and which will be capable of modification for either manual operation or operation by a suitable prime mover from a remote location.

A still further object of this invention is to provide an anchor handling structure including automatic latching structure for latching a raised anchor in a fully raised position against lowering relative to the anchor handling structure.

A further object of this invention, in accordance with the immediately preceding object, is to provide a latching structure including automatic release features whereby the latching structure may be automatically released when desired in order to lower an associated anchor.

A final object of this invention to be specifically enumerated herein is to provide an anchor handling structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
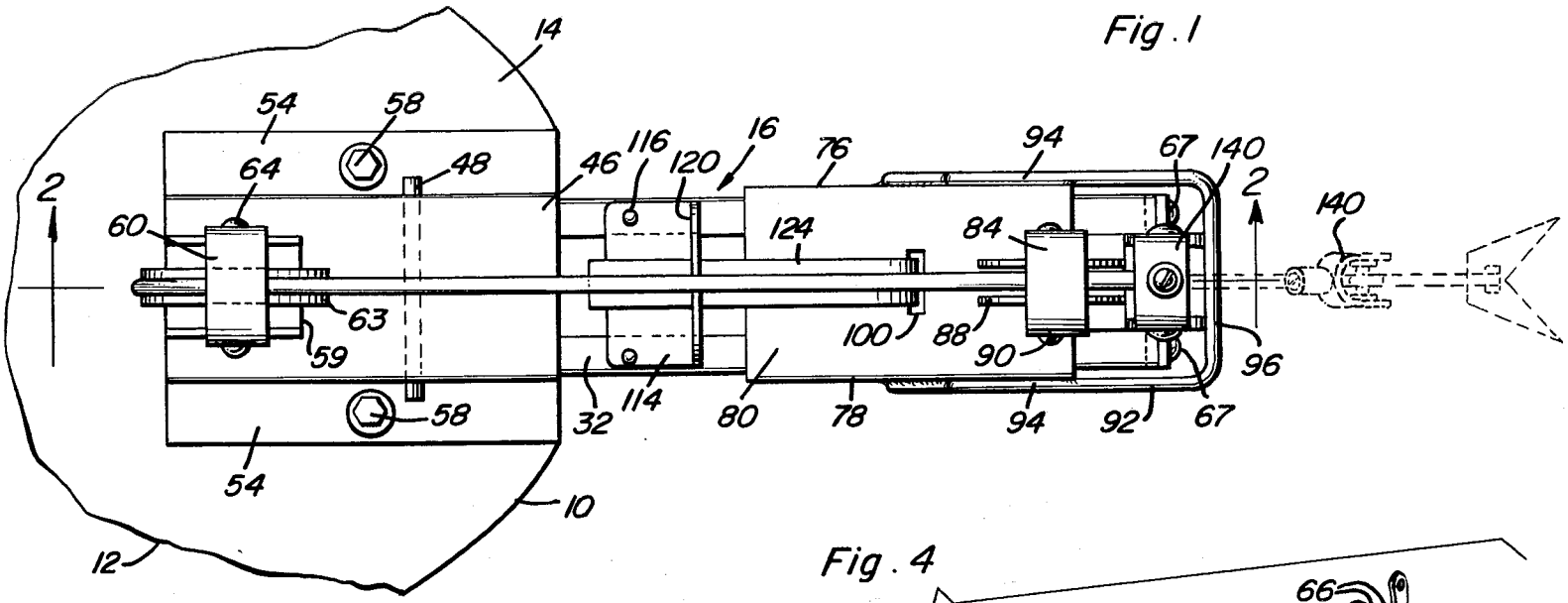
FIG. 1 is a fragmentary top plan view of the bow portion of a boat with the anchor handling structure of the instant invention operatively associated therewith.
Figure 4:
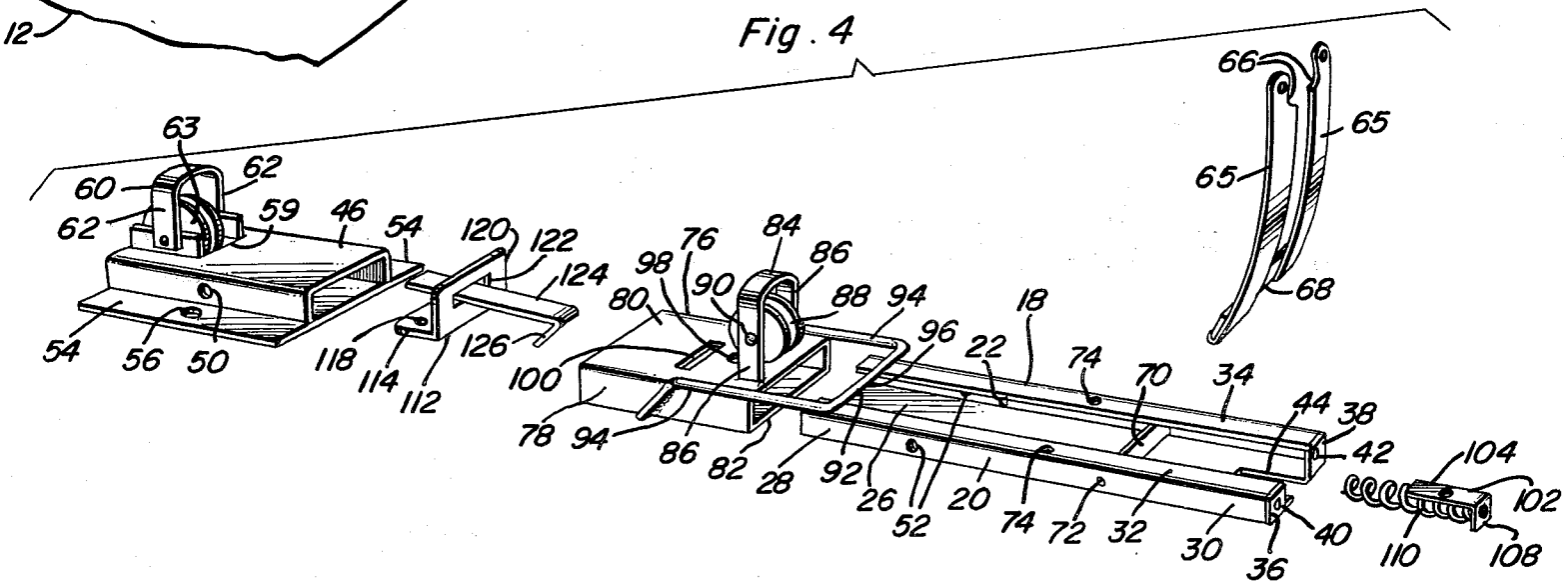
FIG. 4 is an exploded perspective view of the anchor handling structure.

Referring now more specifically to the drawings, the numeral 10 generally designates the bow portion of a boat 12. The bow portion 10 includes an upper deck surface 14 and the anchor line guide and support or anchor handling structure of the instant invention is referred to in general by the reference numeral 16. The structure 16 includes an elongated upwardly opening generally channeled shaped support arm 18 including opposite side upstanding vertical longitudinal flanges 20 and 22 interconnected along their lower marginal edge portions by means of a horizontal bight portion 26. The Support arm 18 includes an inner end 28 and an outer end 30 and the upper marginal edge portions of the longitudinal flanges 20 and 22 terminate in integral inwardly directed horizontal flanges 32 and 34, respectively. Also, the outer ends of the longitudinal flanges 20 and 22 include inwardly directed flanges 36 and 38 having bores 40 and 42 formed therethrough, the flanges 36 and 38 extending between vertically spaced portions of the horizontal flanges 32 and 34 and the outer end marginal portion of the bight portion 26. Also, from FIG. 4 of the drawings, it may be seen that the outer end of the bight portion 26 is provided with an endwise outwardly opening slot 44 whose opposite side marginal edges are spaced inwardly of the inner ends of the corresponding flanges 36 and 38.

A sleeve-type mounting bracket 46 is provided and is snugly telescoped over the inner end 28 of the support arm 18 with a transverse pin 48 being passed through opposite side horizontally registered bores 50 in the mounting bracket 46 and corresponding horizontally registered bores 52 formed in the flanges 20 and 22 to thereby secure the support arm 18 to the mounting bracket 46. In addition, the mounting bracket 46 includes a pair of opposite side horizontal mounting flanges 54 having bores 56 formed therethrough by which the mounting bracket 46 may be secured to the upper deck surface 14 by means of suitable fasteners 58 secured through the bores 56. The end of the mounting bracket 46 remote from the outer end 30 of the support arm 18 is notched as at 59 and includes an inverted U-shaped mount 60 between whose legs 62 a guide pulley wheel 63 is journaled by means of a pivot shaft 64 secured through the lower ends of the legs 62.

Figures 2, 3:
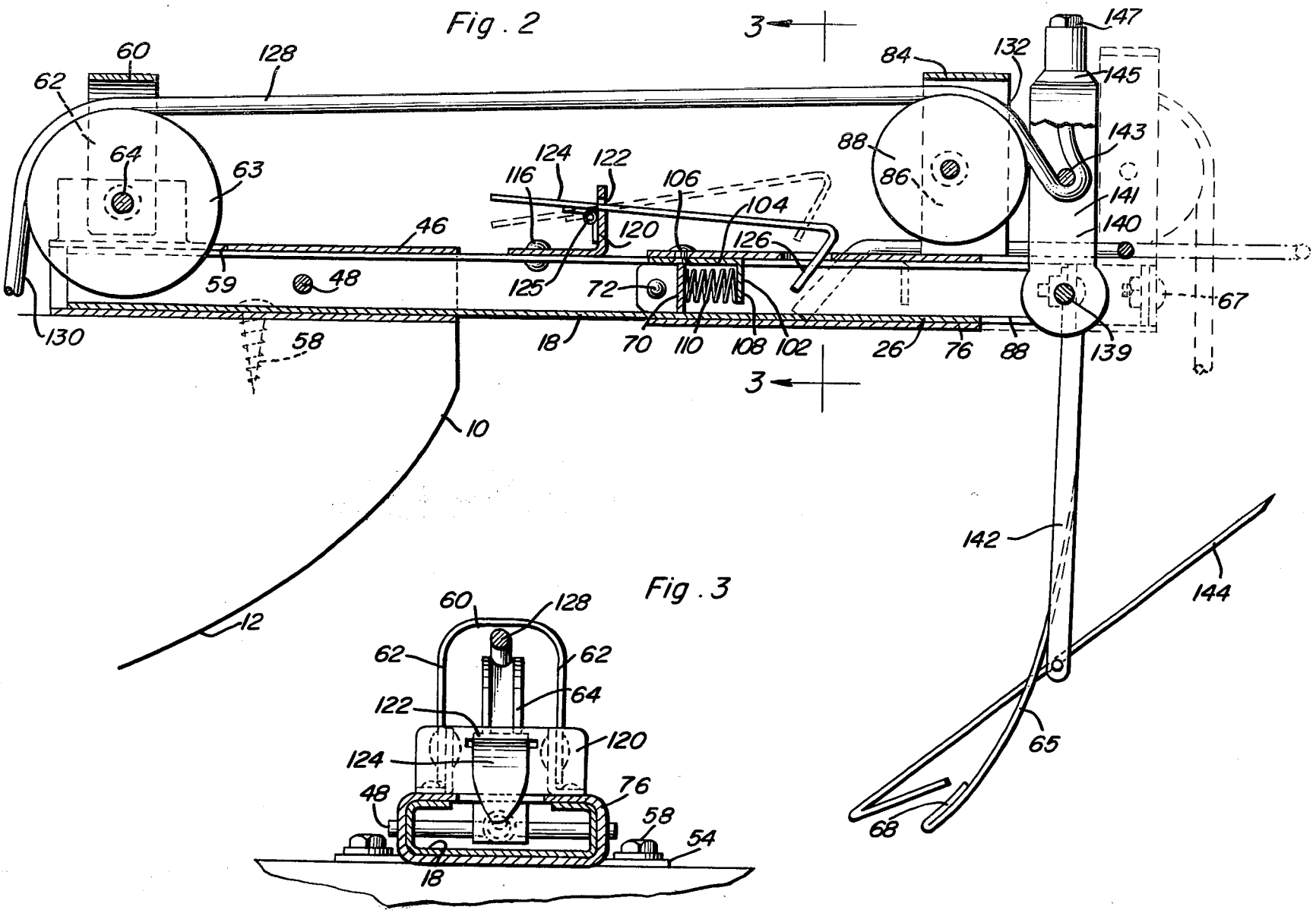
FIG. 2 is an enlarged fragmentary, longitudinal, vertical sectional view, taken substantially upon the plane indicated by the section line 2—2 of FIG. 1, and with an alternate position of a shiftable portion of the anchor handling structure illustrated in phantom lines.
FIG. 3 is a transverse, vertical sectional view, taken substantially upon a plane indicated by the section line 3—3 of FIG. 2.

As may be seen from FIG. 2 of the drawings, the support arm 18 is supported from the bow portion 10 of the boat 12 by means of the mounting bracket 46 with the outer end 30 of the support arm 18 projecting outwardly from the forward extremity of the bow portion 10.

The outer end 30 of the support arm 18 includes a pair of transversely spaced depending and inwardly curving guide members 65 whose upper ends are notched along their inner sides as at 66 and secured to the flanges 36 and 38 by means of fasteners 67. The lower ends of the members 65 are interconnected by means of a horizontal transverse brace member 68 extending and rigidly secured therebetween.

The channel member comprising the support arm 18 includes an internal transverse abutment member 70 extending between the flanges 20 and 22 and secured to the latter by means of suitable fasteners 72. Also, the flanges 32 and 34 include apertures 74 centrally intermediate their opposite ends.

A slide sleeve 76 is slidingly telescoped over the outer end 30 of the support arm 18 and includes opposite sides 78 interconnected by means of top and bottom panel 80 and 82. The forward end of the top panel 80 includes an inverted U-shaped mounting bracket 84 including upstanding legs 86 between whose vertical mid portions a guide wheel 88 is journaled by means of a pivot shaft 90. Also, the forward end of the slide sleeve 76 includes a horizontally disposed U-shaped bail 92 including opposite side legs 94 whose free ends are secured to the outer sides of the opposite sides 78 of the sleeve 76 in any convenient manner, such as by welding. The bail 92 includes a bight portion 96 spaced outwardly of the forward end of the slide sleeve 76 defining a vertical opening enclosed by the bail 92 for a purpose to be hereinafter more fully set forth and the top panel 80 is centrally apertured as at 98 immediately rearward of the legs 86 of the mounting bracket 84 and also transversely slotted as at 100 a spaced distance rearward of the aperture 98.

An L-shaped mounting bracket 102 includes an upper horizontal flange 104 secured to the underside of the top panel 80 by means of a suitable fastener 106 and a depending forward vertical flange 108 received between the flanges 32 and 34 and having a compression spring 110 secured to its rear face and projecting rearwardly therefrom. The rear end of the compression spring 110 is engageable with the abutment member 70 as will be hereinafter more fully set forth and a second L-shaped mounting bracket 112 is provided and includes a horizontal flange 114 secured to the flanges 32 and 34 rearward of the slide sleeve 76 by means of suitable fasteners 116 secured through apertures 118 formed in the flange 114 and the apertures or bores 74 formed in the flanges 32 and 34. The mounting bracket 112 also includes an upstanding flange 120 provided with a transverse slot 122 and a hooked latch member or lever 124 is pivotally attached to the flange 120 by means of a hinge 125 and includes a forward down turned and slightly rearwardly and dowardly inclined hook flange 126 engageable in the slot 100 in a manner to be hereinafter more fully set forth.

An elongated flexible tension member 128 is trained over the pulley wheels or guide wheels 63 and 88 and includes a base end 130 which may be manually pulled or wound about a winch drum (not shown), if desired. The tension member 128 also includes a free end 132 which may be downwardly directed through the slot 44 and between the guide membes 65 forward of the brace member 68. The free end 132 of the tension member 128 includes anchor attaching structure 140 to which the upper end of the shank 142 of an anchor 144 may be removably attached in any convenient manner such as by a retaining bolt 139 secured through the spaced arms 141 of the clevis defined by the structure 140. The free end portion 132 of the tension member 128 passes beneath a transverse guide pin 143 secured between the upper ends of the arms 141 and is directed upwardly and secured to the upper bight portion 145 of structure 140 by means of a fastener 147.

In operation, and with the assumption that the anchor 144 is attached to the free end 132 of the tension member 128 by means of the anchor attaching structure 140 and that the anchor 144 is disposed below the lower end of the guide members 65 with the free end 132 of the tension member 128 extending downwardly through the slot 144 and between the guide members 65, the compression spring 110 (assuming that the latch lever has its hook flange 126 disengaged from the slot 100) serves to yieldingly bias the slide sleeve 76 toward the outermost position thereof illustrated in phantom lines in FIG. 2 of the drawings with the guide wheel 88 disposed substantially fully outwardly of the upper ends of the guide members 65 and the bail bight portion 96 displaced considerably outwardly of the end of the support arm 18. Then, with the compression spring 110 maintaining the slide sleeve 76 in its outer position, an inward pull is applied, either manually or by means of a winch assembly, to the tension member 128 whereby the free end 132 thereof, the anchor attaching structure 140 and the anchor 144 will be raised upward toward the guide structure comprising the guide members 65 and the brace member 68 for receiving the structure 140 upwardly through the opening bounded by the bail 92. As the upper end of the shank portion 142 approaches the lower ends of the guide members 65, the anchor attaching structure 140, which is of greater width than the spacing between the guide members 65, will engage the forward surfaces of the lower ends of the guide members 65 and thus be cammed outward together with the upper end of the shank portion 142 of the anchor 144, upon further upward movement of the anchor member attaching structure 140. Then, the shank portion 142 of the anchor 144 will be received between the guide members 65 and as the anchor member attaching structure 140 is raised to the elevation of the notches 66, the inward pull on the free end 132 of the tension member 128 will be sufficient to inwardly advance the anchor member attaching structure 140 between the upper ends of the guide members 65 and the forward ends of the flanges 32 and 34 and over the upper surface portions of the bight portion 26 disposed on opposite sides of the slot 44. In this manner, the weight of the anchor member attaching structure 140 and the anchor 142 will be supported from the bight portion and a further inward pull on the free end 132 of the tension member 128 will cause the bight portion 145 of the anchor member attaching structure 140 to engage the bracket 84 and to thus inwardly displace the latter as well as the slide sleeve 76 from which the guide wheel 88 is journaled.

As the guide sleeve 76 is inwardly displaced along the support arm 18, the compression spring 110 is compressed against the abutment member 70 and the slot 100 is moved into registry with the lower end of the hook flange 126 of the latching lever 124, thus allowing the hook flange 126 to drop downwardly through the slot 100. At this point, further inward pull on the free end of the tension member 128 may be terminated and the anchor member attaching structure as well as the anchor 144 supported therefrom will be supported by the upper surface portions of the bight portion 26 disposed on opposite sides of the slot 44 against downwardly displacement relative to the support arm 18 and the latch lever 124 will maintain the slide sleeve 76 in its inwardly displaced position, the bight portion 96 of the bail 92 serving to prevent outward movement of the anchor member attaching structure 140 from the bifurcated end of the support arm 18 defined by the slot 44.

When it is desired to release the anchor 144, further inward force is applied to the tension member 128 in order to cam the hook flange 126 upwardly and out of the slot 100. Thereafter, tension on the tension member 128 is quickly released whereby the slotted portion of the slide sleeve 76 will quickly pass beneath and outwardly beyond the lower extremity of the hook flange 126 as the compression spring 110 yieldingly biases the slide sleeve 76 to the outer position thereof, illustrated in phantom lines in FIG. 2 of the drawings. When in this outer position, the slide sleeve 76 has outwardly displaced the anchor member attaching structure 140 from the slot 44 whereby release of the tension on the tension member 128 is sufficient to allow the anchor member attaching structure 140 as well as the anchor 144 to drop by gravity down into the water.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An anchor raising and support structure comprising a support arm including inner and outer ends, mounting structure on said inner end for mounting said support arm from a boat in generally horizontal position with the outer end of said support arm projecting outwardly of one marginal portion of the boat, the outer end of said arm including means in the form of opposite side outer terminal ends defining an endwise outwardly opening slot between said terminal ends, slide structure mounted on said arm including means defining a vertically extending window therethrough, said slide structure being freely shiftable along said arm between a first outward shifted position with said window disposed above the level of said terminal ends and disposed outwardly of said slot and a second inward shifted position with said window having at least a major portion thereof shifted inwardly of the outer extremity of said slot, said slide structure including guide structure elevated above said window, an elongated flexible tension member extending along said arm and having one free end portion passed over said guide structure and downward through said window and provided with anchor attaching structure on its terminal end shiftable vertically through said window and being elevatable by said tension member upwardly through said window to a position disposed juxtaposed to and forward of said guide structure for engagement with the latter upon inward displacement of said anchor attaching structure along said arm, said anchor attaching structure being of a width to bridge said terminal ends above the latter when said anchor attaching structure is elevated upwardly through said window, means yieldingly biasing said slide structure toward the first position thereof, depending second guide structure carried by the outer end of said arm for engagement by said anchor attaching structure from below when the anchor attaching structure is raised upward by said tension member toward the outer end of said arm when said slide is in the first position thereof, said second guide structure being operable to cause said anchor attaching structure, when the latter is being elevated upwardly through said window, to be retained outwardly of the first mentioned guide structure and to thereafter allow said anchor attaching structure to move inwardly over said slot and said terminal ends and into engagement with the first mentioned guide structure, whereby the slide structure may be displaced inwardly along said arm toward said second position thereof upon upward displacement of said attaching structure above the second mentioned guide structure, and releasable latch means carried by said arm for releasably latching said slide in said second position, said anchor attaching structure, after said tension member is slackened subsequent to said slide structure being inwardly shifted to said second position thereof, being operable to bridge said terminal ends for support therefrom.

2. The combination of claim 1 wherein said means defining said vertically extending window includes a portion thereof disposed outwardly of said anchor attaching structure when the latter is in the raised position disposed in said window and operable, when said slide structure is in said second position to prevent outward displacement of said anchor attaching structure relative to said slide structure along said support arm toward said terminal ends.

3. The combination of claim 1 wherein said second guide structure comprises a pair of depending arcuate members supported from said terminal ends, said arcuate members being disposed in spaced side-by-side relation with their convex surfaces facing outwardly of the free end of said support arm, said tension member being receivable between the upper ends of said arcuate members.

4. The combination of claim 3 including a horizontal member extending and secured between the lower ends of said arcuate members.

5. The combination of claim 1 wherein the first mentioned guide structure comprises a pulley wheel journaled from said slide structure and over which said tension member is passed, the axis of rotation of said pulley wheel being horizontally disposed and extending transversely of said arm.

* * * * *